US005735556A

United States Patent [19]

Chan

[11] Patent Number: 5,735,556

[45] Date of Patent: Apr. 7, 1998

[54] CYLINDRICAL LOCKSET WITH REINFORCED CHASSIS ASSEMBLY

[75] Inventor: Eric Chan, Taipei, Taiwan

[73] Assignee: Kolik Enterprise Co., Ltd., Taipei, Taiwan

[21] Appl. No.: 768,856

[22] Filed: Dec. 17, 1996

[51] Int. Cl.[6] ..... E05C 1/12; E05B 3/00

[52] U.S. Cl. ..... 292/169.23; 292/336.3; 292/DIG. 61

[58] Field of Search ..... 292/169.16, 169.23, 292/336.3, DIG. 61, 169.21, 169.22

[56] References Cited

U.S. PATENT DOCUMENTS

| | | | |
|---|---|---|---|
| 4,756,178 | 7/1988 | Shen | 292/169.23 |
| 4,998,760 | 3/1991 | Nixon et al. | 292/DIG. 61 |
| 5,335,948 | 8/1994 | Norton, II et al. . | |
| 5,628,216 | 5/1997 | Qureshi et al. | 292/DIG. 61 |

*Primary Examiner*—Neill R. Wilson
*Attorney, Agent, or Firm*—Cushman Darby & Cushman IP Group of Pillsbury Madison & Sutro LLP

[57] ABSTRACT

A cylindrical lockset includes a latchbolt unit, a chassis assembly, a pair of spring cassettes and a pair of levers. The chassis assembly has a housing, a retractor disposed in the housing and connected operably to the latchbolt unit, and a pair of rollback sleeves extending from opposite sides of the housing. Each of the rollback sleeves includes a tubular body which is formed from a bent steel plate with adjoining longitudinal edges and which has a front end coupled operably with the retractor. Each of the spring cassettes is coupled operably to a respective one of the rollback sleeves. Each of the levers is mounted on a respective one of the rollback sleeves. The chassis assembly further includes a reinforcing ring sleeved on the front end of the tubular body of at least one of the rollback sleeves to force the adjoining longitudinal edges of the tubular body toward each other to prevent prying open of the rollback sleeve.

1 Claim, 3 Drawing Sheets

CYLINDRICAL LOCKSET WITH REINFORCED CHASSIS ASSEMBLY

BACKGROUND OF THE INVENTION

1. Field of the Invention

The invention relates to a cylindrical lockset, more particularly to a cylindrical lockset with a reinforced chassis assembly.

2. Description of the Related Art

The improvement of the present invention is directed to a cylindrical lockset, such as that disclosed in U.S. Pat. No. 5,335,948. Referring to FIG. 1, a conventional cylindrical lockset is shown to comprise a pair of levers 11, a pair of liners 12, a chassis assembly with a housing 14 and a pair of rollback sleeves 13 extending from opposite sides of the housing 14, a pair of spring cassettes 16, and a latchbolt unit 18. Each of the liners 12 is formed with a pair of hollow screw posts 121 for mounting the lockset on a door (not shown) by means of screws 101. Each of the spring cassettes 16 is disposed on an inner side of a respective one of the liners 12. Each of the rollback sleeves 13 is coupled operably with a retractor 141 in the housing 14, and is provided with a stub 131 for coupling with a respective one of the spring cassettes 16. Each of the levers 11 is mounted on a respective one of the rollback sleeves 13. The latchbolt unit 18 is connected operably to the retractor 141. The lockset further includes a rose 102 provided on each of the liners 12, and a cylinder lock 103 provided on one of the levers 11.

Referring to FIGS. 2 and 3, the rollback sleeve 13 includes a tubular body 130 which is formed from a bent steel plate. The tubular body 130 is formed with a slot 135 for receiving a spring-biased catch 133 that is used to retain the respective lever 11 on the sleeve 13. The stub 131 is formed adjacent to a front end of the tubular body 130 by pressing. The front end of the tubular body 130 is further formed with rollback cams 134 that engage the retractor 141. As such, rotation of one of the levers 11 can result in corresponding rotation of one of the rollback sleeves 13, thereby actuating the retractor 141 to retract the latchbolt unit 18.

It should be noted that the rollback sleeve 13 cannot be formed directly from a steel tube and must be formed by bending a steel plate since the stub 131, the slot 135 and the rollback cams 134 have to be formed on the rollback sleeve 13. As such, the conventional rollback sleeve 13 suffers from the following drawbacks:

1. Since the conventional rollback sleeve 13 is not provided with a reinforcing member, the adjoining longitudinal edges 136 of the tubular body 130 may be forced apart to pry open the rollback sleeve 13 after the lever 11 is struck, thereby permitting access to the rollback cams 134 for unlocking the lockset.

2. No engaging unit is formed at the adjoining longitudinal edges 136 of the tubular body 130, thereby making it less difficult to pry open the conventional rollback sleeve 13.

SUMMARY OF THE INVENTION

Therefore, the main object of the invention is to provide a cylindrical lockset with a reinforced chassis assembly which is capable of overcoming the above mentioned drawbacks that are commonly associated with the prior art.

Accordingly, the cylindrical lockset of the present invention includes a latchbolt unit, a chassis assembly, a pair of spring cassettes and a pair of levers. The chassis assembly has a housing, a retractor disposed in the housing and connected operably to the latchbolt unit, and a pair of rollback sleeves extending from opposite sides of the housing. Each of the rollback sleeves includes a tubular body which is formed from a bent steel plate with adjoining longitudinal edges and which has a front end coupled operably with the retractor. Each of the spring cassettes is coupled operably to a respective one of the rollback sleeves. Each of the levers is mounted on a respective one of the rollback sleeves. The chassis assembly further includes a reinforcing ring sleeved on the front end of the tubular body of at least one of the rollback sleeves to force the adjoining longitudinal edges of the tubular body toward each other to prevent prying open of the rollback sleeve.

Preferably, one of the adjoining longitudinal edges of the tubular body is formed with a dovetail projection. The other one of the adjoining longitudinal edges of the tubular body is formed with a dovetail groove which engages the dovetail projection to provide additional protection against prying open of the rollback sleeve.

BRIEF DESCRIPTION OF THE DRAWINGS

Other features and advantages of the present invention will become apparent in the following detailed description of the preferred embodiment with reference to the accompanying drawings, of which.

DESCRIPTION OF THE PREFERRED EMBODIMENT

The preferred embodiment of a cylindrical lockset of this invention is generally similar to the conventional cylindrical lockset described beforehand. For the sake of brevity, only the portions which distinguish the preferred embodiment from the aforementioned conventional cylindrical lockset will be detailed herein.

The main difference between the lockset of this invention and the conventional one described beforehand resides in the configuration of the chassis assembly. More particularly, the chassis assembly of the preferred embodiment further includes a reinforcing ring sleeved on at least one of the rollback sleeves.

Figure 1:
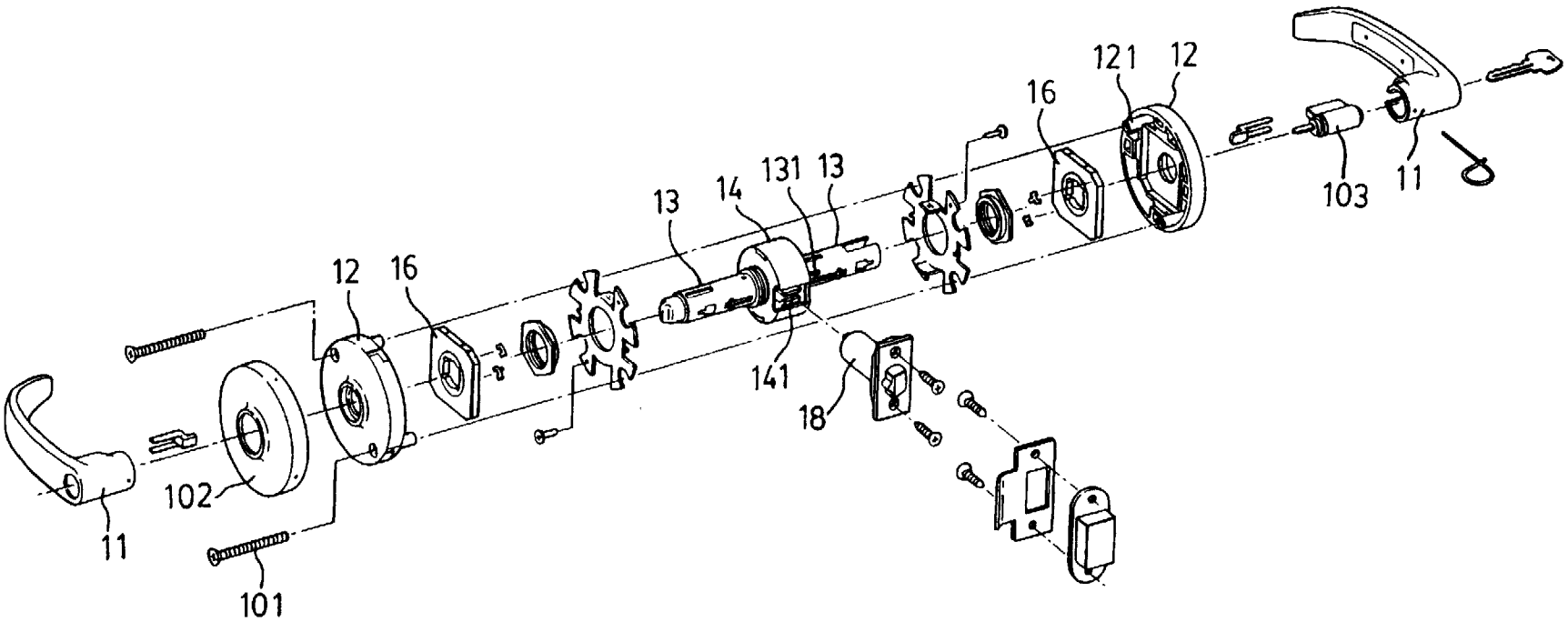
FIG. 1 PRIOR ART
FIG. 1 is an exploded view of a conventional cylindrical lockset.
Figure 2:
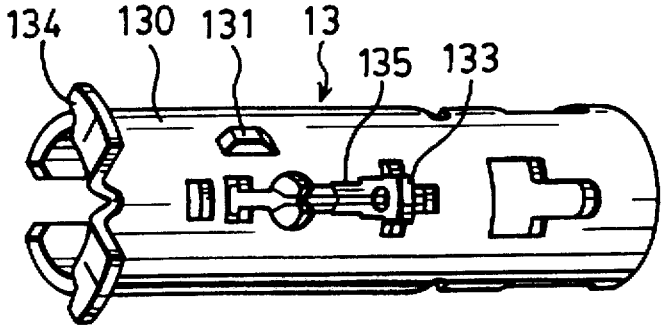
FIG.2 PRIOR ART
FIG. 2 is a perspective view of a rollback sleeve of the conventional cylindrical lockset.
Figure 3:
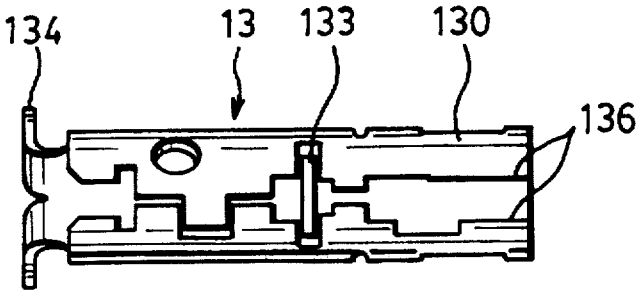
FIG.3 PRIOR ART
FIG. 3 is a schematic view of the conventional rollback sleeve shown in FIG. 2.
Figure 4:
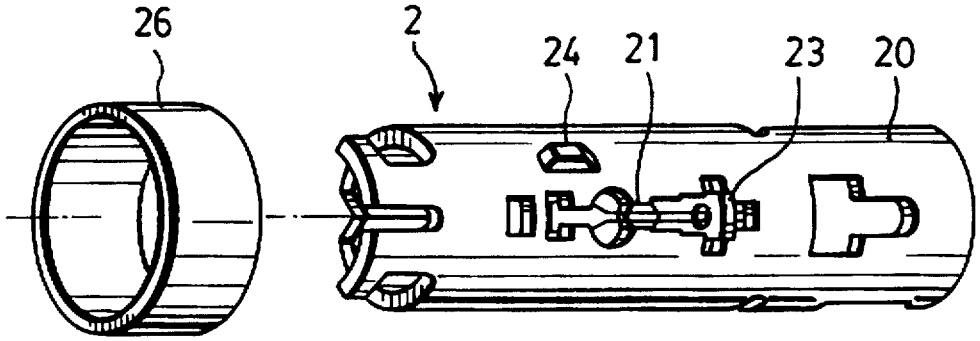
FIG. 4 illustrates a rollback sleeve and a reinforcing ring of the preferred embodiment of a cylindrical lockset according to the present invention.
Figure 5:
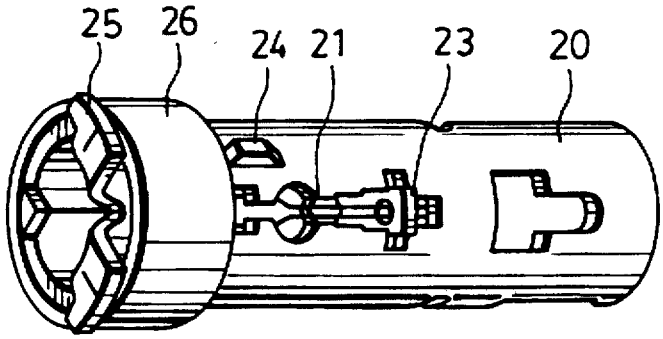
FIG. 5 illustrates how the reinforcing ring is sleeved on the rollback sleeve in accordance with the present invention.
Figure 6:
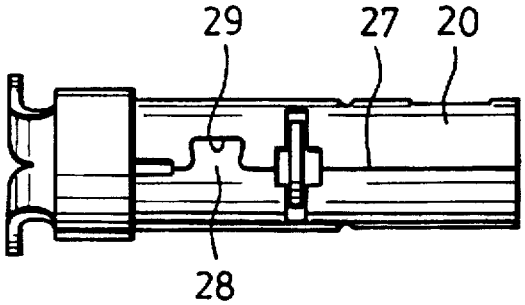
FIG. 6 is a schematic view which illustrates how adjoining longitudinal edges of a tubular body of the rollback sleeve are engaged in accordance with the present invention.

As shown in FIGS. 4, 5 and 6, the rollback sleeve 2 of the chassis assembly of the preferred embodiment includes a tubular body 20 which is formed from a bent steel plate with adjoining longitudinal edges 27. The tubular body 20 is provided with a slot 21 for receiving a spring-biased catch 23 that is used to retain a respective lever (not shown) on the sleeve 2. The tubular body 20 is further formed with a stub 24 adjacent to a front end of the same by pressing. The stub 24 is used for coupling the sleeve 2 to a respective spring cassette (not shown). The front end of the tubular body 20 is further formed with rollback cams 25 for engaging a retractor (not shown) in the housing of the chassis assembly. The reinforcing ring 26 is sleeved on the front end of the tubular body 20 prior to forming of the rollback cams 25. As such, the adjoining longitudinal edges 27 of the tubular body 20 are forced by the reinforcing ring 26 toward each other to prevent prying open of the rollback sleeve 2. In addition, one of the adjoining longitudinal edges 27 of the tubular body 20 is formed with a dovetail projection 28. The other one of the adjoining longitudinal edges 27 of the tubular body 20 is formed with a dovetail groove 29 which engages the dovetail projection 28 to provide additional protection against prying open of the rollback sleeve 2.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A cylindrical lockset, comprising:

a latchbolt unit, a chassis assembly including a housing, a retractor disposed in said housing and connected operably to said latchbolt unit, and a pair of rollback sleeves extending from opposite sides of said housing, each of said rollback sleeves including a tubular body formed from a bent steel plate with adjoining longitudinal edges, said tubular body having a front end coupled operably with said retractor, a pair of spring cassettes, each of which is operatively coupled to a respective one of said rollback sleeves, and a pair of levers, each of which is mounted on a respective one of said rollback sleeves, said chassis assembly further including a reinforcing ring sleeved on said front end of said tubular body of at least one of said rollback sleeves to force said adjoining longitudinal edges of said tubular body toward each other to prevent prying open of said rollback sleeve, and wherein one of said adjoining longitudinal edges of said tubular body is formed with a dovetail projection, the other one of said adjoining longitudinal edges of said tubular body being formed with a dovetail groove which engages said dovetail projection to provide additional protection against prying open of said rollback sleeve.

* * * * *